US012441574B1

(12) United States Patent
Chalmers

(10) Patent No.: US 12,441,574 B1
(45) Date of Patent: Oct. 14, 2025

(54) TAPE RETAINING SPRING WIRE FOR TAPE GUN

(71) Applicant: Steven Chalmers, Castle Rock, CO (US)

(72) Inventor: Steven Chalmers, Castle Rock, CO (US)

( * ) Notice: Subject to any disclaimer, the term of this patent is extended or adjusted under 35 U.S.C. 154(b) by 207 days.

(21) Appl. No.: 18/133,174

(22) Filed: Apr. 11, 2023

Related U.S. Application Data

(60) Provisional application No. 63/418,281, filed on Oct. 21, 2022.

(51) Int. Cl.
*B65H 35/00* (2006.01)

(52) U.S. Cl.
CPC ..... *B65H 35/0033* (2013.01); *B65H 35/0073* (2013.01)

(58) Field of Classification Search
CPC ..... B65H 35/0033; B65H 35/0073
USPC ..... 242/588; 156/576, 579
See application file for complete search history.

(56) References Cited

U.S. PATENT DOCUMENTS 2,235,704 A * 3/1941 Gorbatenko ..... B65H 35/0033 242/909
2,532,596 A * 12/1950 Bobrov ..... B65H 35/008 156/523
3,813,274 A * 5/1974 Rothenberger .... B65H 35/0033 156/527
4,818,329 A * 4/1989 Tutas ..... B65H 35/0033 156/577
5,236,540 A * 8/1993 Shi ..... B65H 35/0033 156/523
5,641,377 A * 6/1997 Chung ..... B65H 35/0033 156/577
7,591,037 B1 * 9/2009 Strickland ..... B26B 11/00 7/156
9,493,322 B1 * 11/2016 Lam ..... B65H 35/0033
2004/0244917 A1 * 12/2004 Wojtkun ..... B65H 35/0033 156/577
2014/0311677 A1 * 10/2014 Huang ..... B29C 65/00 156/510
2017/0297853 A1 * 10/2017 Gallegos ..... B26D 7/00
2019/0112144 A1 * 4/2019 Naber ..... B65H 35/0033
2023/0032801 A1 * 2/2023 Woolman ..... B25F 1/04

* cited by examiner

*Primary Examiner* — Anna M Momper
*Assistant Examiner* — Tiffany Domonique Jefferson
(74) *Attorney, Agent, or Firm* — Edwin H. Crabtree

(57) ABSTRACT

A tape retaining spring wire adapted for attachment to a front of a tape gun. The tape gun includes a handle attached to a bottom of a tape gun mounting plate. Also mounted to a front of the mounting plate is a tape guide. The tape guide is used to guide adhesive tape from a tape roll. The tape roll is attached to a top of the mounting plate. Further, a tape smoothing roll, a cutting blade, and a tape pressing wiper are attached to the front of the mounting plate. The tape retaining spring wire is permanently attached to the front of the tape guide, the spring wire adapted to prevent a loose end of the tape from dropping down and sticking to a portion of the tape guide.

8 Claims, 3 Drawing Sheets

TAPE RETAINING SPRING WIRE FOR TAPE GUN

This utility patent application claims the benefit of an earlier filed provisional patent application, Ser. No. 63/418,281, filed on Oct. 21, 2022, by the subject inventor, and having a title of "RETAINER WIRE FOR TAPE GUN".

BACKGROUND OF THE INVENTION

(a) Field of the Invention

This invention relates to a retainer wire used with a tape gun. The tape gun is used for applying adhesive tape to seal boxes and packages.

(b) Discussion of Prior Art

Heretofore, when applying adhesive tape to a box or package, the tape is cut to length using a cutting blade. The tape is unrolled from a tape roller. The tape roller is mounted on a tape gun. Once the tape is cut, a loose end on the tape roll, bound only by a tape guide, is free to unintentionally stick to a portion of a tape guide. The subject invention eliminates the loose end of the tape from sticking to the tape gun using a tape retaining spring wire.

SUMMARY OF THE INVENTION

In view of the foregoing, it is a primary object of the subject invention to help prevent a loose end of an adhesive tape from sticking to a portion of a tape gun, after cutting the tape from a tape roll.

Another object of the invention is the use of a discrete tape retaining spring wire attached to a front of the tape guide, mounted on the tape gun. The spring wire is used to engage the loose end of the adhesive tape and prevent it from engaging the tape guide.

Still another object of the invention is the spring wire holds the loose end of the tape above the tape guide for easily applying the tape to another package or box.

Yet another object of the invention is the retainer wire can be integral to the tape gun or an add-on feature to the tape gun.

In one embodiment, the subject invention includes a tape retaining spring wire. The spring wire is adapted for attachment to a front of a tape gun. The tape gun includes a handle attached to a bottom of a tape gun mounting plate. Also mounted to a front of the mounting plate is a tape guide. The tape guide is used to guide adhesive tape from a tape roll. The tape roll is attached to a top of the mounting plate. Further, a tape smoothing roll, a cutting blade, and a tape pressing wiper are attached to the front of the mounting plate. The tape retaining spring wire is attached to the front of the tape guide and prevents a loose end of the tape from dropping down and sticking to a portion of the tape guide.

These and other objects of the present invention will become apparent to those familiar with tape guns used for sealing boxes and packages when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject retainer wire for a tape gun, and in which.

DESCRIPTION OF THE PREFERRED EMBODIMENTS

Figure 1:
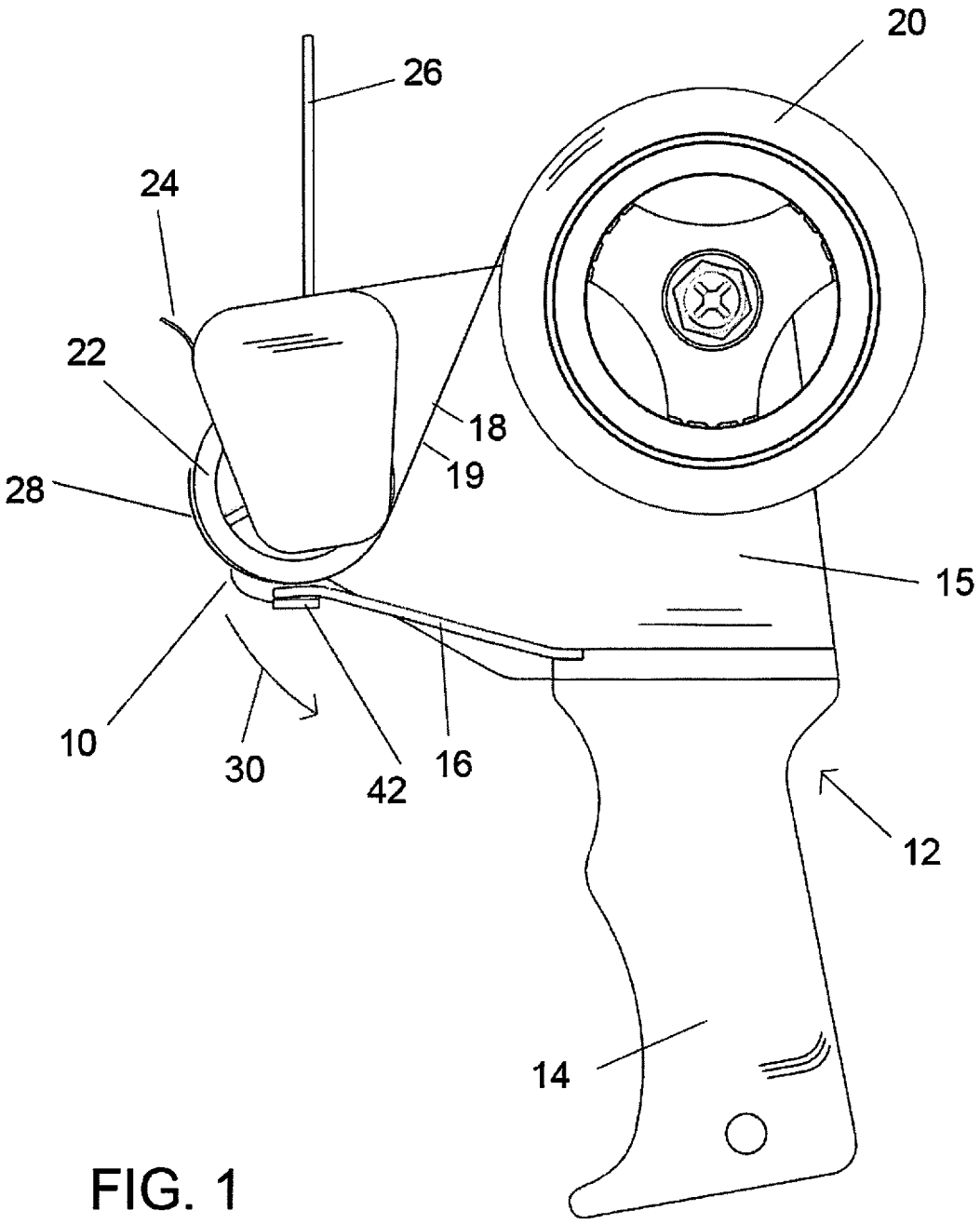
FIG. 1 is a side view of a tape gun with a tape retaining spring wire. The spring wire is permanently attached or removeably attached to a front of a tape guide for engaging a loose end of an adhesive tape.

In FIG. 1, a side view of a tape gun is shown having a general reference numeral 12. The tape gun 12 includes a tape retaining spring wire 10 adapted for attachment to a front of the tape gun 12. The tape gun includes a handle 14 attached to a bottom of a tape gun mounting plate 15. Also mounted to a front of the mounting plate 15 is a tape guide 16. The tape guide 16 is used to guide adhesive tape 18, having an adhesive side 19, or sticky side, from a tape roll 20. The tape roll 20 is attached to a top of the mounting plate 15.

Further, a tape smoothing roller 22, a cutting blade 24, and a tape pressing wiper 26 are attached to the front of the mounting plate 15. It should be noted that in one embodiment, one end of the tape retaining spring wire 10 can be permanently attached to a front of the tape guide 16. In another embodiment of the invention, a portion of the spring wire 10 can be removeably attached to the tape guide using adhesive tape 42. This feature in shown in FIG. 3. As mentioned above, the spring wire 10 prevents a tape loose end 28 of the tape 18 from dropping down, as indicated by arrow 30, and sticking to a portion of the tape guide 16 or any other part of the tape gun 12. The spring wire 10 has a length typically in a range of 1 to 2 inches. Also, the spring wire has the characteristics of spring steel, for retaining its shape when pressed between the tape and the top of a box or package.

Figure 2:
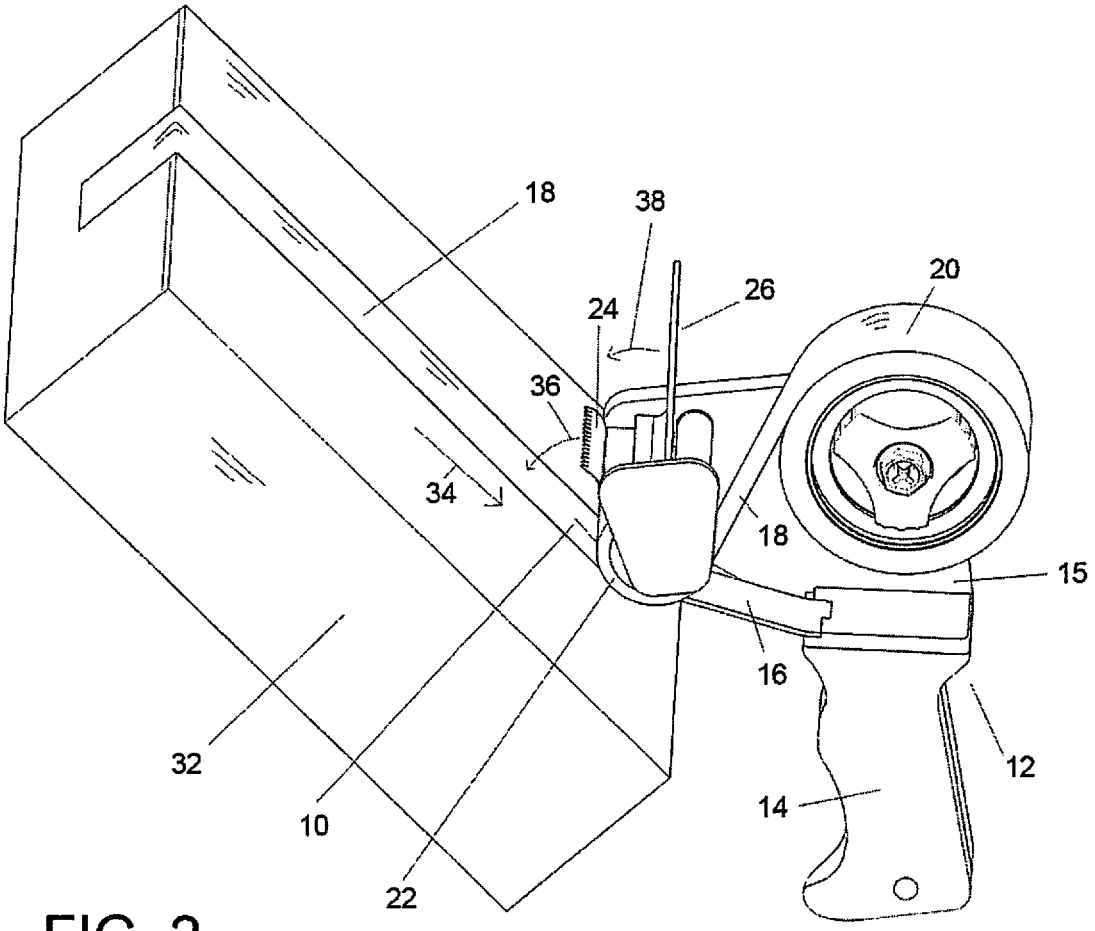
FIG. 2 is a perspective view of the tape gun in operation and applying tape to close a top of a box or a package. The spring wire is shown engaging a portion of the tape as the tape is unrolled for sealing the top of the box.

In FIG. 2, a perspective view of the tape gun 12 is shown in operation and applying the adhesive tape 18 to the top of a box 32. The spring wire 10 is shown engaging a portion of the tape 18 as the tape is unrolled, as indicated by arrow 34, for sealing the box. In this drawing, when the cutting blade 24 is lowered, as indicated by arrow 36, the tape 18 can be cut to a desired length. Further, the tape pressing wiper 26 can be lowered on top of the tape, as indicated by arrow 38, for pressing down on top of the tape and smoothing it along the length of the tape as it seals the top of the box 32.

Figure 3:
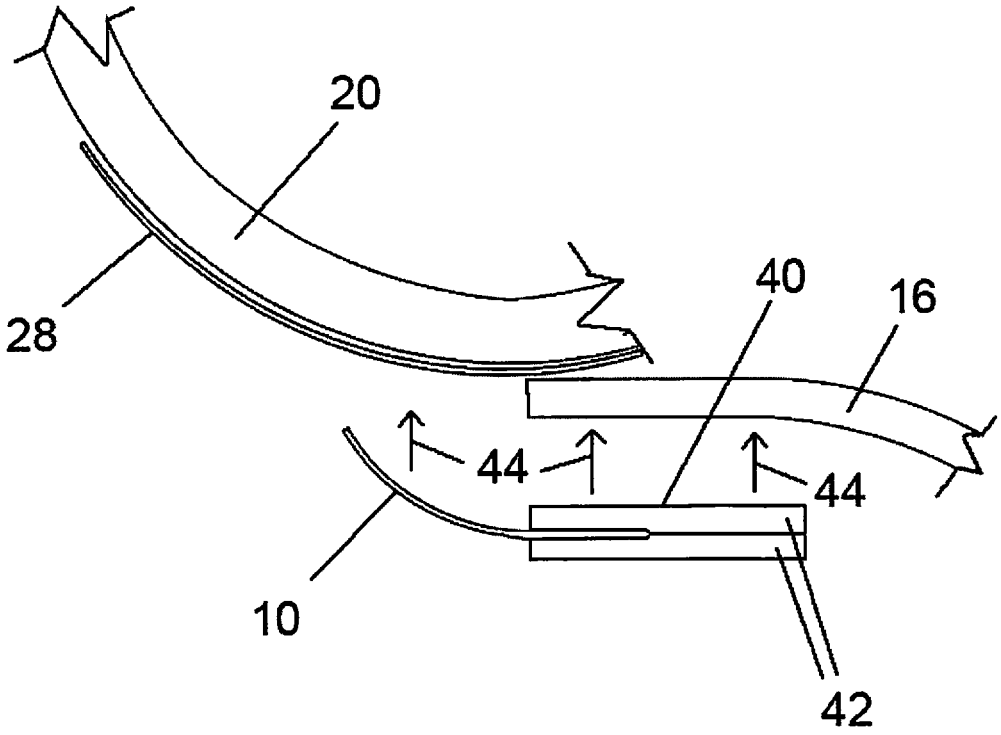
FIG. 3 is an enlarged side view of the spring wire and adhesive tape, as a separate unit, positioned to be attached to the top of the tape guide. The spring wire is small enough to not interfere with the tape being applied to the box or package.

In FIG. 3, an enlarged side view of the spring wire 10 and the adhesive tape 42, are shown as a separate and removable unit. One end of the spring wire 10 is shown sandwiched between two layers of the tape 42. An adhesive face 40, of the adhesive tape 42, is shown positioned to be attached, as indicated by arrows 44, to an end portion of the tape guide 16. An opposite end of the spring wire 10, has a curvature similar to the curvature of the tape roll 20. The spring wire 10 is shown in this drawings positioned to engage an end portion of the tape lose end 28. It should be noted that the spring wire 10 is small enough not to interfere with the tape 18 as it is being applied to the box 32. Once the tape 18 has been cut and sealed the box, the spring wire 10 returns to its original curved shape and held against the end of the tape 10 on the tape roll 20.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A tape gun having a handle mounted on a bottom of a tape gun mounting plate, a tape guide mounted on a front of the tape gun mounting plate, a tape roll, with an adhesive tape, mounted on the tape gun mounting plate, a tape smoothing roller mounted in a front of the tape gun mounting plate, and a cutting blade mounted in the front of the tape gun mounting plate, the tape gun used for applying the adhesive tape to a box, the tape gun including:

a tape retaining spring wire attached to the front of the tape guide, the tape retaining spring wire curving upwardly toward the tape smoothing roller, the tape retaining spring wire configured to be sandwiched between the adhesive tape and the box;

whereby when the adhesive tape is cut by the cutting blade, the tape retaining spring wire adapted to prevent a loose end of the cut adhesive tape from engaging the tape guide, and the tape retaining spring wire in continuous contact with the adhesive tape before and after cutting the adhesive tape.

2. The tape gun as described in claim 1 wherein the tape retaining spring wire is permanently attached to the front of the tape guide.

3. The tap gun as described in claim 1 wherein the tape retaining spring wire is removably attached to the front of the tape guide.

4. The tape gun as described in claim 1 wherein the tape retaining spring wire has a length in a range of 1 to 2 inches.

5. The tape gun as described in claim 1 wherein the tape gun includes a tape pressing wiper attached to the front of the mounting plate, the tape pressing wiper adapted for pressing the cut tape along a length of the box.

6. A tape gun having a handle mounted on a bottom of a tape gun mounting plate, a tape guide mounted on a front of the tape gun mounting plate, a tape roll, with an adhesive tape, mounted on the tape gun mounting plate, a tape smoothing roller mounted in a front of the tape gun mounting plate, and a cutting blade mounted in the front of the tape gun mounting plate, the tape gun used for applying the adhesive tape to a box, the tape gun including:

a tape retaining spring wire attached to the front of the tape guide, the tape retaining spring wire permanently attached to the front of the tape guide, the tape retaining spring wire curving upwardly toward the tape smoothing roller, the tape retaining spring wire configured to be sandwiched between the adhesive tape and the box;

whereby when the adhesive tape is cut by the cutting blade, the tape retaining spring wire adapted to prevent a loose end of the cut adhesive tape from engaging the tape guide, and the tape retaining spring wire in continuous contact with the adhesive tape before and after cutting the adhesive tape.

7. The tape gun as described in claim 6 wherein the tape retaining spring wire has a length in a range of 1 to 2 inches.

8. The tape gun as described in claim 6 wherein the tape gun includes a tape pressing wiper attached to the front of the mounting plate, the tape pressing wiper adapted for pressing the cut tape along a length of the box.

* * * * *